United States Patent [19]

Deason

[11] 4,387,877

[45] Jun. 14, 1983

[54] APPARATUS FOR FORMING POOL DECK AND COPING

[76] Inventor: Max W. Deason, 1818 W. Price St., Tucson, Ariz. 85705

[21] Appl. No.: 322,390

[22] Filed: Nov. 17, 1981

[51] Int. Cl.[3] ..... E04G 11/02

[52] U.S. Cl. ..... 249/9; 249/10; 249/19; 249/90; 249/190; 249/211; 249/DIG. 3

[58] Field of Search ..... 249/9, 10, 19, 90, 211, 249/213, 214, DIG. 3, 190

[56] References Cited

U.S. PATENT DOCUMENTS

| | | | |
|---|---|---|---|
| 2,020,515 | 11/1935 | Newton | 249/213 |
| 3,348,801 | 10/1967 | Deason | 249/DIG. 3 |
| 3,526,070 | 9/1970 | Deason | 249/DIG. 3 |
| 3,653,628 | 4/1972 | Shoemaker | 249/214 |
| 3,850,403 | 11/1974 | Stegmeier | 249/19 |
| 4,245,810 | 1/1981 | Green | 249/19 |

*Primary Examiner*—John A. Parrish

*Attorney, Agent, or Firm*—Drummond, Nelson & Nissle

[57] ABSTRACT

Improved apparatus for forming the deck and associated coping of a pool. The pool defines and encloses a central area for receiving and retaining water and includes a substantially vertical wall and a generally horizontal bond surface adjacent the wall, the bond surface and pool wall intersecting at and defining a horizontal edge along the upper portion of the pool wall. The improved apparatus comprises a continuous strip of semirigid material and an elongate support member for maintaining the strip of material in position against the upper portion of the pool wall. The continuous strip of semirigid material includes a facing surface which is positioned below the horizontal pool edge against the upper portion of the pool wall; a front form surface extending upwardly from the facing surface to form a contoured surface for temporarily supporting concrete poured above the horizontal edge onto the bond surface of the pool, the concrete forming a pool deck and coping thereof contiguous to the pool wall when set; and, a back wall surface generally opposed to the front form surface and facing the central area of the pool. The elongate support member passes through the continuous strip of semirigid material and is secured to the bond surface of the pool to maintain the continuous strip in position against the pool wall.

11 Claims, 5 Drawing Figures

APPARATUS FOR FORMING POOL DECK AND COPING

This invention pertains to apparatus for constructing a deck and its associated coping along the upper horizontal edge of the wall of a pool.

More particularly, the invention pertains to pool deck construction apparatus including elongate support members and including a semirigid pool deck form strip having both a facing surface which is positioned against the pool wall below the upper edge thereof and a contoured form surface extending upwardly from the facing surface to contain concrete poured onto a horizontal bonding surface extending along the upper edge of the pool, the elongate support members temporarily holding the strip form in position against the pool wall.

In another respect, the invention pertains to pool construction apparatus of the type described in which the facing surface of the semirigid pool deck strip form is effectively maintained in position against a pool wall when a thin film of oil or dust covers the pool wall or covers ceramic tile embedded in the portion of the pool wall opposing the facing surface of the semirigid strip form.

In a further respect, the invention pertains to apparatus for forming a pool deck which can be quickly installed by relatively unskilled persons using only simple, conventional hand tools.

In still another respect, the present invention pertains to apparatus of the type described in which a first portion of each elongate support member remains embedded in the pool deck formed by concrete poured after the semirigid strip form is emplaced and in which the remaining portion of each elongate support member is readily manually severable from the first portion thereof such that the semirigid strip form can be quickly and conveniently removed after the poured concrete has set.

Semirigid, disposable pool deck strip forms of the type disclosed in my U.S. Pat. No. 3,526,070 have been extensively used to form the pool deck and associated coping which extend along the upper edge of the wall of a pool. Such forms manually comprise a strip of polystyrene having a flat facing surface which is positioned along a pool wall just below the horizontal upper edge of the wall and having a contoured form surface extending upwardly from the facing surface to temporarily support concrete poured above the upper edge of the pool wall, the concrete forming the pool deck and associated coping when set. Pressure sensitive adhesive carried by the facing surface of the form strip secures the strip in position on the upper portion of the pool wall, normally on smooth ceramic tile inlaid in the pool wall. After the poured concrete has hardened, the disposable polystyrene strip and adhesive are readily peeled off the ceramic tile.

Although semirigid polystyrene strip forms with pressure sensitive adhesive provide a simple, inexpensive means for forming pool deck coping, several problems associated with the use of such forms have limited the acceptance of the forms by the relevant market.

In particular, the decorative ceramic edging tile which are usually embedded in the upper portion of a swimming pool wall often have, when new, a hard to remove oil-like film which prevents the pressure sensitive adhesive carried on the facing surface of polystyrene strip forms from completely binding to the tile, especially when the polystyrene forms are attached to curved portions of the pool wall. At times, this oil film has caused the facing adhesive to separate from ceramic edging tile soon after concrete has been poured and is bearing against the contoured form surface of a polystyrene strip.

In addition, hydrokinetic forces exerted by concrete while it is being poured and the hydrostatic forces exerted by concrete after it is poured tend to force or bend the upper portion of a lightweight polystyrene strip form away from the edge and toward the center of the pool, causing the coping formed by hardened concrete to be misshapen.

In the past, metal braces and wood cleats have been utilized to provide additional support for polystyrene strip forms, but such support structures are unwieldly and time consuming and detract from the primary advantages associated with the forms; namely, their inexpensive cost of manufacture and simplicity of use.

Accordingly, it would be highly desirable to provide inexpensive, readily installed pool deck strip form construction apparatus which could be maintained in position against the ceramic tile along the upper portion of a pool wall even when a thin film of oil or other foreign matter was coating the tile.

Therefore, it is a principal object of the instant invention to provide improved apparatus for forming the deck and associated coping of a pool.

Another object of the invention is to provide apparatus for forming the deck and coping of a pool which includes a semirigid strip form having a facing surface positioned against the upper portion of the pool wall and having a contoured form surface extending upwardly from the facing surface to temporarily support concrete poured above the horizontal upper edge of the swimming pool and, which includes auxiliary structural members for holding the semirigid strip form in position against the upper portion of the pool wall when concrete is poured and bears against the contoured form surface of the semirigid strip.

A further object of the invention is to provide pool deck construction apparatus of the type described in which the auxiliary structural members that provide additional support for the semirigid form strip are inexpensive, are readily installed by persons of limited mechanical skill and are readily disassembled after poured concrete has set and the semirigid strip form can be removed from its position against the pool wall.

Still another object of the instant invention is to provide pool deck construction apparatus of the type described in which a first portion of each auxiliary structural member supporting a semirigid strip form is embedded in and strengthens concrete poured after the semirigid strip form is positioned against the upper portion of the pool wall and in which the remaining portion of each structural member is attached to and can be readily severed from the embedded first portion thereof.

These and other, further and more specific objects and advantages of the invention will be apparent to those skilled in the art from the following detailed description thereof, taken in conjunction with the drawings, in which.

Figure 1:
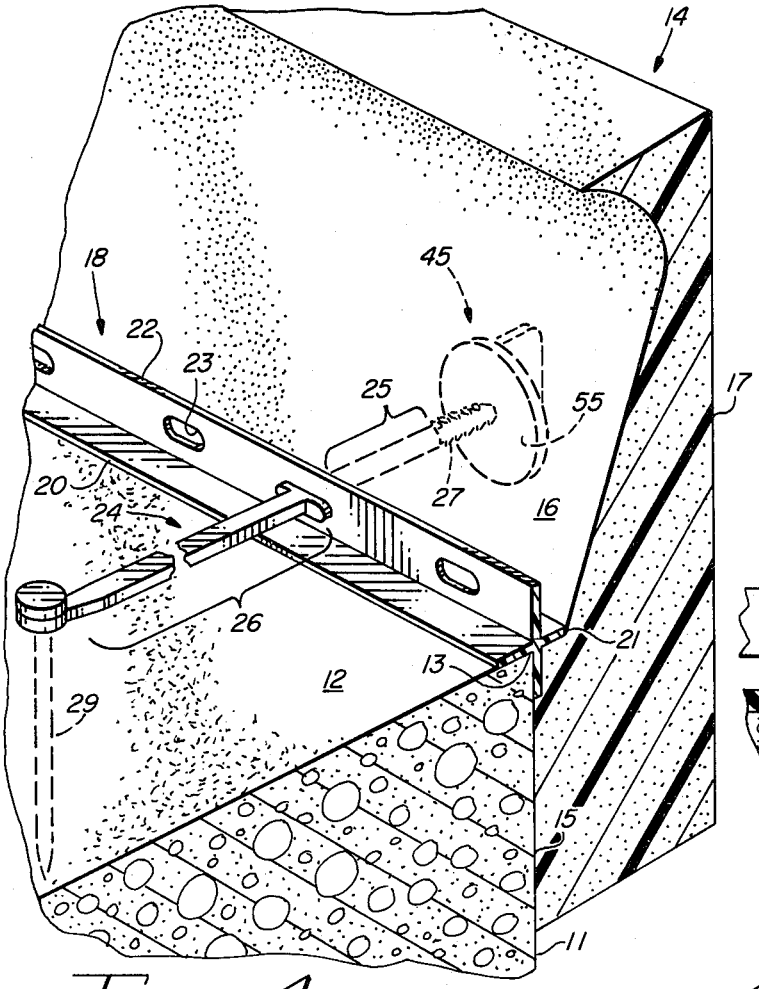
FIG. 1 is a perspective view of pool deck strip form apparatus constructed in accordance with the presently preferred embodiment of the invention and positioned adjacent the upper portion of a pool wall to temporarily support and contain poured concrete which, when solidified, forms the deck and associated coping the pool.
Figure 3:
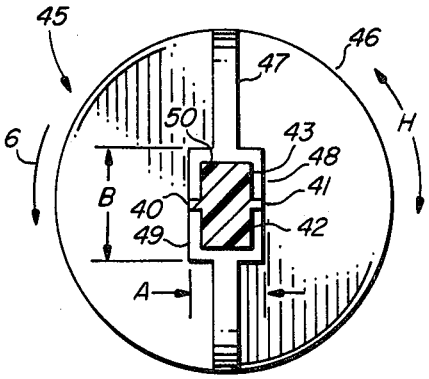
FIG. 3 is a section view of an element of the apparatus of FIG. 2 taken along section line 3—3 thereof.
Figure 4:
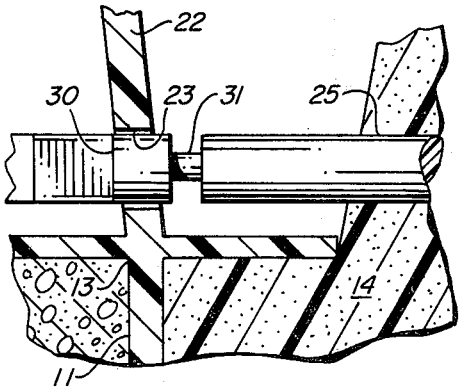
FIG. 4 is an enlarged elevation view of the portion of the apparatus of FIG. 2 enclosed by dashed circle 4 thereof.

Briefly, in accordance with my invention, I provide improved apparatus for forming the deck and associated coping of a pool. The pool defines and encloses a central area for receiving and retaining water and includes a substantially vertical wall and a generally horizontal bond surface adjacent the wall, the bond surface and pool wall intersecting, terminating at and defining a generally horizontal edge, the edge being at the upper portion of the pool wall. The improved apparatus comprises a continuous strip of semirigid material including a facing surface, the facing surface being positioned below the upper horizontal edge of the pool wall and against the upper portion of the pool wall, a front form surface extending upwardly from the facing surface to form a contoured surface for temporarily supporting concrete poured above the horizontal edge onto the bond surface of the pool, the concrete forming a pool deck and coping thereof contiguous to the pool wall when set, and a back wall surface generally opposed to said front form surface and facing the central area of the pool; and an elongate member. The elongate member has a pair of ends and middle section and is shaped such that at least one of the ends passes through the continuous strip and the middle section is positioned in the continuous strip between the front form surface and back wall surface thereof; one of the ends is positioned outside the continuous strip adjacent the back wall surface toward the central area of the pool, the end adjacent the back wall surface being adapted to fixedly receive and carry a securing member having a surface contoured to fit against the back wall surface of the continuous strip; and the other of the ends is positioned outside of the continuous strip adjacent the bond surface, the end adjacent the horizontal bond surface being adapted to be fixedly secured to the bond surface such that at least a portion of the elongate member is in tension when the securing member is fixedly carried by the first end thereof and presses against the back wall surface of the continuous strip. The elongate member and securing member hold the continuous strip in position against the pool wall.

Turning now to the drawings in which the presently preferred embodiments of the invention are shown for the purpose of illustrating the practice thereof and not by way of limitation of the scope of the invention, and in which like reference characters represent corresponding elements throughout the several views, FIGS. 1–5 illustrate the presently preferred embodiment of the invention in combination with a pool including a substantially vertical wall 11 intersecting horizontal bond surface 12 to form horizontal edge 13. Continuous strip form 14 includes a generally planar facing surface 15 positioning against pool wall 11 and upwardly extending, contoured form surface 16. Back wall surface 17 is generally opposed to front form surface 16 and faces the central area of the pool. Cove strip 18 extends continuously along horizontal edge 13 with strip form 14 and includes downwardly extending, panel-shaped foot 19, generally horizontal depending panel-shaped wings 20, 21 and upwardly extending panel shaped member 22 provided with apertures 23. Strip form 14 is preferably fabricated from lightweight polystyrene and maintains cover strip 18 in position along horizontal edge 13 by pressing foot 19 against pool wall 11.

Elongate support member 24 includes a middle section 25 and ends 26, 27. The distal portion of end 26 is provided with eyelet 28 so that end 26 may be secured to bonding surface 12 with concrete nail 29. Rectangular segment 30 of elongate structural member 24 is dimensioned to slip into aperture 23 such that segment 30 cannot be rotated in aperture 23. Segment 30 is integrated with end 26 and is connected to the remaining length of elongate support member 24 by frangible throat 31. Pointed end 27 includes four rectangular ridges 40, 41, 42 and 43, each of the ridges being perpendicular to two of the other remaining ridges. Ridges 42, 43 are respectively provided with teeth 35, 34. T-shaped aperture 44 in cap member 45 slidably receives end 27 of elongate member 24. The distance, indicated by arrow A in FIG. 3, from the outer edge of ridge 40 to the outer edge of ridge 41 is different than the distance, indicated by arrow B, from the outer edge of ridge 42 to the outer edge of ridge 43. Since aperture 44 is contoured so that its inner shape and dimensions are just great enough to slidably receive end 27, end 27 must be properly oriented, i.e., with ridges 43, 42 respectively extending upwardly and downwardly as in FIGS. 1, 2, 3, 5, in order to be able to slide end 27 into aperture 44. Once end 27 is pushed through aperture 44 and into tapered channel 51, it cannot be rotated.

Cap member 45 includes circular base 46 having perpendicular, outwardly depending tabs 47 and an outwardly depending substantially rigid rectangular housing including an upper half 48 and the lower half 49. Tapered channel 51 passes through housing 48, 49. Circular base 46 of cap 45 is resilient so that when end 27 and teeth 34, 35 thereof are forced through opening 50 at the end of tapered channel 51 in the direction indicated by arrow E in FIG. 2, housing halves 48, 49 respectively separate and move in the direction indicated by arrows C and D. The rotational separation of housing halves 48, 49 temporarily enlarges opening 50 and permits the tips of teeth 34, 35 to pass therethrough. After the outer tip of a tooth 34 or 35 forces opening 50 to enlarge and then passes through the enlarged opening 50, resilient base 46 of cap 45 causes opening 50 to spring back to its original smaller size. Teeth 34, 35 are offset from one another so that if a vertical line were drawn through the tip of one of the lower teeth 35 in FIG. 2, the line would pass midway between the outermost tips of two of upper teeth 34. Offsetting the teeth in this fashion permits the size of each individual tooth to be increased while still allowing cap 45 to be moved along end 27 in relatively small increments of adjustment.

Figure 2:
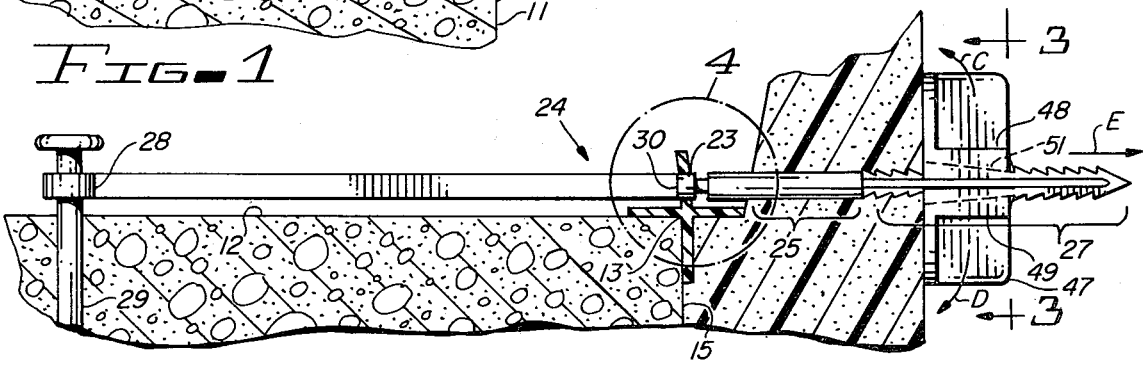
FIG. 2 is a side sectional view of the apparatus of FIG. 1 further illustrating construction details thereof.
Figure 5:
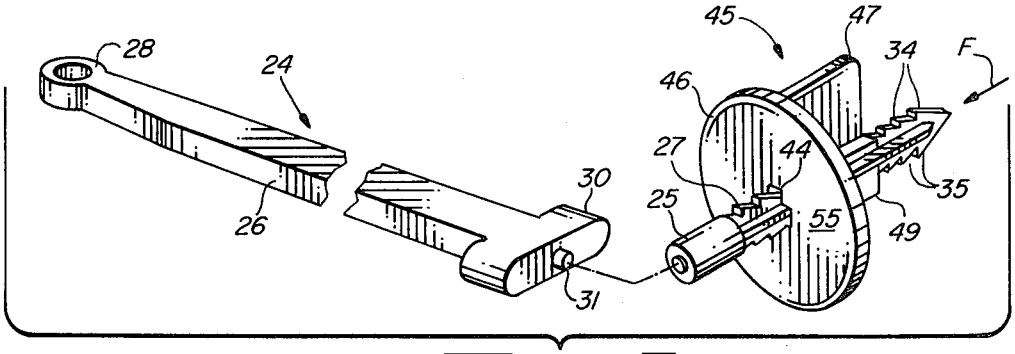
FIG. 5 is a perspective view of one of the elements of the apparatus of FIGS. 1 and 2 illustrating the frangible nature thereof.

In operation, cove strip 18 and continuous strip form 14 are positioned along the upper portion of pool wall 11 as shown in FIGS. 1 and 2. End 27 of elongate member 24 is then pushed through an aperture 23 of cover strip 18 and through strip form 14 until segment 30 of elongate member 24 is centered in aperture 23. When segment 30 is centered in aperture 23, at least a portion of end 27 has passed through and from back wall surface 17 toward the central area of the pool while at least a portion of end 26 of elongate member 24 is positioned over and adjacent to bond surface 12. A cement nail 29 is then driven through eyelet 28 to secure end 26 in position adjacent bond surface 12. After nail 29 is driven, aperture 44 of cap 45 is slipped over end 27 of elongate member 24 and back surface 55 of circular base 46 of cap 45 is pushed up against back wall surface 17 of strip form 14. As earlier described, cap 45, due to the resilient nature of base 46, readily slides onto end 27 in the direction of arrow F in FIG. 5, but once the cap is pushed against back wall 17 of strip form 14, the interaction of teeth 34, 35 and opening 50 prevent cap 45 from moving in the direction of arrow E in FIG. 2. Strip form 14 is presently preferably fabricated from polystyrene or some other resilient, inexpensive, lightweight material; and, when cap 45 is positioned on end 27 a fair amount of force can be applied in the direction of arrow F so that the polystyrene is slightly compressed and a "tight fit" is obtained. Normally, when cap 45 is positioned as illustrated in FIGS. 1 and 2, sections 25, 26 and 27 of member 24 are in tension because the expansive forces of the slightly compressed polystyrene act against back surface 55 of cap 45 causing 45 to "pull" on sections 25, 27, 27 of member 24.

Since strip form 14 is typically formed from polystyrene, elongate member 24 is positioned as shown in FIG. 1 by simply pushing pointed end 27 through the solid polystyrene form 14. Of course, end 27, or for that matter end 26, could be passed through an aperture formed in the strip form 14, especially if the form were constructed of less penetrable material.

After the pool deck strip form apparatus is installed as depicted in FIGS. 1 and 2, concrete is poured and allowed to set. When the poured concrete has reasonably solidified, cap 45 is grasped by tabs 47 and turned in the direction of either arrow G or H of FIG. 3. This causes end 27 and middle section 25 to rotate and, since segment 30 and aperture 23 effectively prevent end 27 from rotating, causes member 24 to fracture along frangible section 31. Strip form 14, along with sections 25, 27 of member 24 and cap 45, is then removed from the side of the pool and the coping formed along the inner edge of the pool by contoured form surface 16 of strip 14 is finish troweled by a mason. End 26 of member 24 remains embedded in and strengthens the poured concrete.

Elongate support member 24 and cap 45 are currently fabricated from plastic and are, along with polystyrene strip form 14, discarded after use. Pressure sensitive adhesive can be carried along facing surface 15 to help maintain strip 14 in position against pool wall 11.

Support members 24 and associated caps 45 can be utilized at points spaced one to three feet apart along strip 14 or as otherwise desired.

Having described my invention in such terms as to enable those skilled in the art to understand and practice it, and having identified the presently preferred embodiments thereof, I claim:

1. An apparatus for forming a deck and coping thereof for said pool, said apparatus comprising, (a) a continuous strip of semirigid material including
  (i) a facing surface generally free of adhesive and positioned below said horizontal edge against said upper portion of said pool wall,
  (ii) a front form surface extending upwardly from said facing surface to form a contoured surface for temporarily supporting concrete poured above said horizontal edge onto said bond surface of said pool, said concrete forming a pool deck and coping thereof contiguous to said pool wall when set, and
  (iii) a back wall surface generally opposed to said front form surface and facing said central area of said pool;

(b) an elongate support member having a first end, a second end, and a middle section, said support member being shaped such that at least one of said ends can be passed through said continuous strip such that
  (i) a portion of said middle section is positioned in said continuous strip between said front form surface and back wall surface thereof,
  (ii) said first end is positioned outside said continuous strip adjacent said back wall surface and is adapted to receive and carry a securing member having a surface contoured to fit against said back wall surface of said continuous strip, and
  (iii) said second end is positioned outside of said continuous strip adjacent to said horizontal bond surface, and is adapted to be fixedly secured to said bond surface such that at least a portion of said elongate member is in tension when said securing member is carried by said first end thereof and presses against said back wall surface of said continuous strip, said elongate member and securing member holding said facing surface of said continuous strip in fixed position against said pool wall; and (c) a supplemental elongate strip positioned on said bond surface along said horizontal termination edge between said bond surface and said upper portion of said pool wall, said supplemental edge strip including an elongate upstanding panel member extending along said bond surface generally parallel to said pool wall, said upstanding panel member including a plurality of spaced apertures formed therethrough, said middle section of said elongate support member passing through one of said spaced apertures of said supplemental strip.

2. The apparatus of claim 1 wherein said facing surface of said continuous strip of semirigid material is provided with adhesive.

3. The apparatus of claim 1 wherein said first end of said elongate support member is shaped and dimensioned such that said securing member (a) is readily pushed onto said first end in a direction of travel generally perpendicular to and toward said pool wall,
(b) partially locks in each of a series of incremental positions such that said securing member may, until said securing member contacts and is pressed against said back wall surface, be moved toward said back wall surface from one of said incremental locking positions to another of said incremental locking positions, and
(c) is prevented from being moved from one of said incremental positions on said first end in a direction of travel away from said pool wall.

4. The apparatus of claim 3 wherein said middle section of said elongate support member includes a first, second and third segment, said third segment (a) being attached to said first end of said elongate support member, and (b) having a rounded surface on at least a portion thereof so that said third segment is easily rotated inside said continuous semirigid strip.

5. The apparatus of claim 4 wherein said second segment of said middle section of said elongate support member is (a) attached to said second end of said elongate support member, (b) positioned inside one of said apertures formed through said supplemental strip, and (c) shaped, contoured and dimensioned to prevent rotation thereof in said aperture.

6. The apparatus of claim 5 wherein said second segment of said middle section of said elongate support member is positioned between said first and third segments and is frangible.

7. The apparatus of claim 6 wherein said second end of said elongate support member includes a flat planar surface positioned adjacent said horizontal bond surface to inhibit rotation of said second end of said elongate support member.

8. The apparatus of claim 7 wherein said securing member includes an aperture formed therethrough for receiving said first end of said elongate support member.

9. The apparatus of claim 8 wherein said aperture formed in said securing member is shaped, contoured and dimensioned to prevent rotation of said securing member with respect to said first end of said elongate support member when said securing member is pushed onto said first end of said elongate support member.

10. The apparatus of claim 9 wherein said securing member is adapted to be manually grasped and rotated, the manual rotation of said securing member causing said first end and said first segment of said middle section of said elongate support member to rotate and fracture said second segment of said middle section of said elongate support member.

11. The apparatus of claim 10 wherein said facing surface of said continuous strip is provided with adhesive.

* * * * *

UNITED STATES PATENT AND TRADEMARK OFFICE

CERTIFICATE OF CORRECTION

PATENT NO. : 4,387,877

DATED : June 14, 1983

INVENTOR(S) : MAX W. DEASON

It is certified that error appears in the above-identified patent and that said Letters Patent are hereby corrected as shown below:

In Column 5, line 60, delete "said pool" and insert --a pool-- therefor.

In Column 5, line 63, delete "said horizontal edge" and insert --the horizontal edge-- therefor.

In Column 5, line 64, delete "said upper portion" and insert --the upper portion-- therefor.

In Column 5, line 64, insert --a wall of-- after the words "upper portion of".

In Column 5, line 64 delete "pool wall", and insert --pool-- therefor.

In Column 5, line 68, delete "above said horizontal edge onto said bond" and insert --onto a generally horizontal bond-- therefor.

In Column 6, line 1, delete "of said pool" and insert --terminating at said horizontal edge of said pool -- therefor.

UNITED STATES PATENT AND TRADEMARK OFFICE

CERTIFICATE OF CORRECTION

PATENT NO. : 4,387,877

DATED : June 14, 1983

INVENTOR(S) : MAX W. DEASON

It is certified that error appears in the above-identified patent and that said Letters Patent is hereby corrected as shown below:

In Column 6, line 5, delete the word "said" and insert --the-- therefor.

Signed and Sealed this

*Twenty-third* Day of *August 1983*

[SEAL]

*Attest:*

GERALD J. MOSSINGHOFF

*Attesting Officer*

*Commissioner of Patents and Trademarks*